US008056776B2

(12) United States Patent
Lee et al.

(10) Patent No.: US 8,056,776 B2
(45) Date of Patent: Nov. 15, 2011

(54) REFRACTORY POURING TUBE WITH POROUS INSERT

(75) Inventors: Stephen Lee, Cardross (GB); Ian Proudfoot, Bowling (GB); David Bloomfield, Beith (GB)

(73) Assignee: Refractory Intellectual Property GmbH & Co. KG, Wien (AT)

( * ) Notice: Subject to any disclaimer, the term of this patent is extended or adjusted under 35 U.S.C. 154(b) by 803 days.

(21) Appl. No.: 11/997,080

(22) PCT Filed: Jul. 8, 2006

(86) PCT No.: PCT/EP2006/006706
§ 371 (c)(1),
(2), (4) Date: Jun. 30, 2008

(87) PCT Pub. No.: WO2007/025601
PCT Pub. Date: Mar. 8, 2007

(65) Prior Publication Data

US 2008/0264982 A1 Oct. 30, 2008

(30) Foreign Application Priority Data

Aug. 27, 2005 (EP) ..... 05018656

(51) Int. Cl.
*B22D 41/58* (2006.01)

(52) U.S. Cl. ..... 222/603; 222/591; 222/606; 266/220; 164/475

(58) Field of Classification Search ..... 222/606, 222/600, 603, 590, 591; 266/220; 164/475
See application file for complete search history.

(56) References Cited

U.S. PATENT DOCUMENTS

| | | | | | |
|---|---|---|---|---|---|
| 4,429,816 | A * | 2/1984 | Thrower | 222/603 |
| 4,510,191 | A * | 4/1985 | Kagami et al. | 428/34.4 |
| 4,854,487 | A * | 8/1989 | Ando et al. | 222/606 |
| 5,676,195 | A * | 10/1997 | Vassilicos | 164/475 |
| 5,885,473 | A * | 3/1999 | Ando et al. | 222/590 |
| 6,568,571 | B2 * | 5/2003 | Ando et al. | 222/606 |

FOREIGN PATENT DOCUMENTS

| | | |
|---|---|---|
| JP | 59225862 | 12/1984 |
| JP | 06126400 | 5/1994 |
| WO | WO01/66284 A1 | 9/2001 |

* cited by examiner

*Primary Examiner* — Scott Kastler
*Assistant Examiner* — Michael Aboagye
(74) *Attorney, Agent, or Firm* — Charistopher L. Parmelee; Walker & Jocke

(57) ABSTRACT

The invention generally relates to a refractory pouring tube for pouring a molten metal from one metallurgical vessel to another metallurgical vessel. The invention as well relates to a corresponding assembly, comprising such a pouring tube.

7 Claims, 1 Drawing Sheet

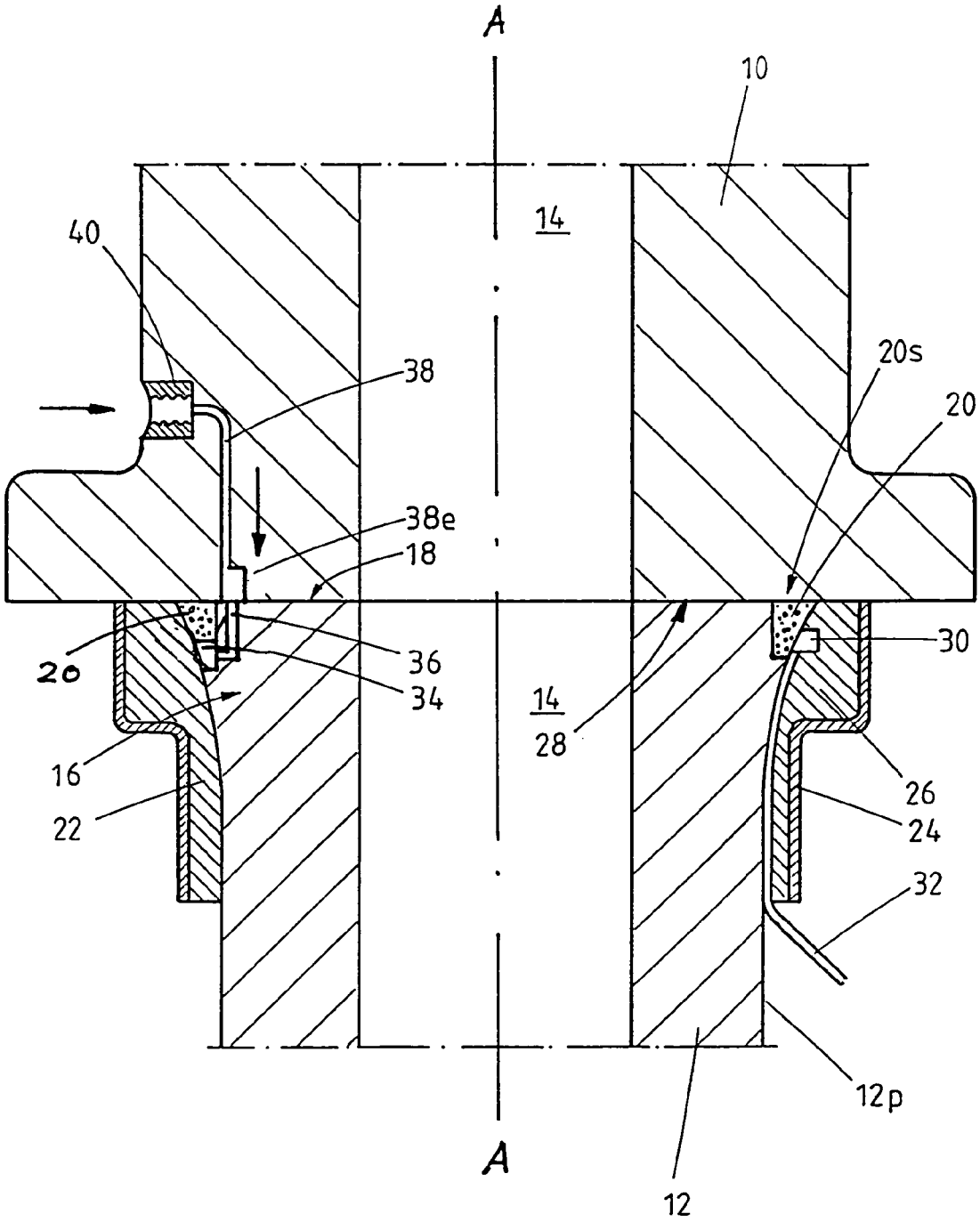
A
10
14
40
38
20s
20
38e
18
20
36
34
30
14
28
16
22
26
24
32
12p
A
12

REFRACTORY POURING TUBE WITH POROUS INSERT

BACKGROUND

The invention generally relates to a refractory pouring tube for pouring a molten metal from one metallurgical vessel to another metallurgical vessel. The invention as well relates to a corresponding assembly, comprising such a pouring tube.

It is known in continuous casting of metal melts to use pouring tubes for transferring the molten metal from one metallurgical vessel to another. Such metallurgical vessels comprise ladles, tundishes, ingot moulds etc. During the casting process any contact between the metallurgical melts and ambient air must be avoided.

WO 01/66284 A1 discloses a grooved refractory tube for such purposes. The tube comprises a first end with a first flat contact surface, perpendicular to a longitudinal axis of the tube, and a pouring channel, extending from said first flat contact face towards a second end of the tube, wherein the pouring channel terminates in one or more outlet openings at the second end of the tube. To avoid the entrance of air into the melt flow the first flat contact surface is provided with a so called injection groove. This groove forms, in conjunction with the first contact surface a fluid injection channel which at least partially encircles the said pouring channel.

According to WO 01/66284 A1 this channel may itself become clogged, i.e. blocked during the casting process. This phenomenon has been observed in the case were the injection groove is formed in a surface of a refractory pouring tube bearing against the surface of another refractory component intended to be replaced during casting operations, for example, when the injection groove is formed in the lower surface of an inner nozzle bearing against the upper surface of a pouring shroud or a submerged entry nozzle. Therefore WO 01/66284 A1 proposes to provide an additional groove along the corresponding contact face of said further refractory components, so that at least one of said grooves may operate correctly during casting.

This proposal cannot avoid the risk that one or both of said grooves become blocked during operation which leads to ineffective gas protection and the tendency for air aspiration.

Therefore an object of the present invention is to provide a refractory pouring tube and a corresponding assembly which is/are easy to produce and provide(s) effective means for protecting the metal melt running through said tube against ingress of ambient air.

The invention avoids any of said injection grooves but integrates a gas permeable member into the surface area of the pouring tube being in contact with an associated refractory component. A treating gas, especially an inert gas, is fed into said gas permeable member at a distance to the first flat contact surface. The gas is guided through said member and then leaves the gas permeable member across its upper (free, open) surface which forms part of the first flat contact surface.

During operation, when the second refractory component is arranged in a way where its corresponding contact surface is in direct contact with the first flat contact surface of the tube, the gas, fed under pressure into said gas permeable member, escapes into any slits between the said corresponding contact surfaces and thus avoids the danger of any undesired air entrance.

Similar to the gas provided by a groove the gas provided by the gas permeable member will surround the pouring channel like a curtain, but without any danger of becoming blocked.

BRIEF SUMMARY

In its most general embodiment the invention relates to a refractory pouring tube, comprising a first end with a first flat contact face, perpendicular to a longitudinal axis of the tube, and a pouring channel, extending from said first flat contact face towards a second end of the tube, which pouring channel terminates in at least one outlet opening at the second end of the tube, wherein the first end of the tube is equipped with at least one gas permeable member, which gas permeable member being arranged such that one of its surfaces forms part of the first flat contact face and that a gas may be introduced into it.

The gas permeable member may be ring shaped. This makes it possible to provide a continuous, ring shaped gas curtain around the pouring channel (at a radial distance to the pouring channel). The gas permeable member (ring) may have a width of any size, for example 5 to 25 mm. Its depth (height) may be in the same range. The said ring may have a rectangular cross sectional area.

The gas permeable member may be a separate entity, positioned within the said first end of the tube. The permeable member may be either co-formed with the tubular element (the tube) or fabricated as a separate entity and positioned within the tube during an assembly process.

In order to lead a gas to said gas permeable member the invention discloses various designs. According to one embodiment the first end of the tube is further equipped with at least one gas channel, extending from at least one surface of the gas permeable member other than the surface forming part of the first flat contact face to at least one further outer surface of the first end of the tube.

Accordingly the channel may extend from a surface of said permeable member opposite to the first flat contact surface to a different area of the first flat contact surface and/or to any circumferential area of the tube.

In order to provide a constant gas flow and a constant gas pressure it is proposed in a further embodiment of the invention to provide a gas distribution chamber (plenum chamber) between the gas permeable member and the gas channel. This gas distribution plenum chamber may extend along a certain length of said permeable member, but it may as well extend along the total length of it.

The gas permeable member may be arranged at any position along the first flat contact face. According to one embodiment, which is shown in the figures following the description, the permeable member is designed as a gas permeable ring along an outer periphery of the first flat contact face. This makes it possible to provide the gas feeding means independently from the tube, for example in or along a corresponding support for the tube.

Typically the first end of the pouring tube is of enlarged cross section (diameter), thus providing a flange like first end (the upper part of the tube in its mounted position). The tube is then positioned with its flange like part within the said support. The gas may then be introduced into the gas permeable member from outside. For example a gas distribution chamber may be arranged radially with respect to the gas permeable member and opening directly into the gas permeable member. Gas may be fed into that gas distribution chamber via a corresponding gas feeding line, provided as well within said support.

In another embodiment the gas permeable member is arranged between the inner and outer periphery of the first flat contact face. The outer periphery may be of any shape, for example rectangular, oval, circular. The inner periphery will mostly have a circular cross section. In such an embodiment a gas channel may extend from any surface of the gas permeable member other than the surface forming part of the first flat contact face through the refractory body of the pouring tube to any surface area of the tube to which a corresponding gas feeding pipe may be connected.

Another possibility is to provide the gas via a corresponding separate refractory component, for example via a nozzle with a flat surface bearing against the first flat contact face of the tube. This gas channel may be arranged in alignment with a corresponding gas channel arranged within the tube and extending from the first flat contact surface to the gas permeable member or a plenum chamber surrounding the gas permeable member at least partly. This embodiment provides the advantage of the gas feeding means being arranged in a fixed element (the nozzle) without need of replacement at any time when the tube is replaced. Again gas distribution means (plenum chamber) may be arranged along the respective gas passages.

The multiple inert gas exit points from the permeable refractory element surface provides two dimensional coverage across the sliding surface with minimal risk that blockage can occur at any one location to allow a path for air ingress.

The channel(s) feeding the gas may be positioned to the side of the bore in position(s) remote from the track across the flat surfaces, along which the bore of the tube must move during an exchange process. In such embodiment there are no channels in either surface which could become blocked during use.

Further features of the invention may be derived from the other application documents as well as from the claims.

BRIEF DESCRIPTION OF THE DRAWING

The invention is described in more detail with respect to the attached FIGURE. This FIGURE shows—schematically—a tube together with a corresponding nozzle in a vertical cross sectional view.

DETAILED DESCRIPTION

In the FIGURE reference 10 depicts a refractory ceramic nozzle, while reference 12 depicts a corresponding pouring tube. Both the nozzle 10 and the pouring tube 12 have a pouring channel 14 being arranged in axial alignment with each other in a mounted position (as shown). This axial alignment includes possible alternatives with a larger diameter of the pouring tube.

Pouring tube 12 has a first (enlarged) end 16 (the upper end in the mounted position), provided with a first flat contact surface 18. Along an outer periphery 12*p* of said tube 12 a ring shaped gas permeable member 20 is positioned within the first end 16 in such a way that its upper surface 20*s* forms part of the first flat contact face 18, while its outer peripheral surface forms part of the circumferential tube surface 12*p*. This gas permeable member 20 is made of a porous ceramic refractory material and positioned within the first end 16 of tube 12 during an assembly process.

Pouring tube 12 is fixedly secured within a support 22, comprising a metallic outer can 24 and an inner refractory part 26.

The lower part of pouring tube 12 is of common design and not shown in the FIGURE.

Nozzle 10 is made as well of a ceramic refractory material and has a second flat contact face 28 at its lower end (as shown in the FIGURE).

Typically there is no space between the corresponding flat contact surfaces 18, 28 in order to avoid any air ingress along said contact area into a metal melt running through pouring channel 14.

The fixation of nozzle 10 is common and not shown in detail.

The FIGURE shows two different examples (embodiments) to arrange a gas feed to the gas permeable member 20.

In the right part of the FIGURE a ring shaped gas plenum distribution chamber 30 is provided at the inner face of support 22 directly opposite to gas purging member 20. A gas feeding pipe 32 extends from said gas distribution ring 30 to a gas pressure station (not shown). The gas, fed along feeding pipe 32 is blown into the gas distribution plenum chamber 30 and then into the gas permeable member 20. Under ideal conditions the gas permeable chamber 20 is under constant gas pressure and no gas (inert gas) escapes along the first flat contact face 18. In practice there are always slits, grooves or other deficiencies within said first and/or second flat contact surfaces 18, 28 so that some of this inert gas under pressure flows either inwards towards the bore 14 or outwards towards the exterior of the assembly, thereby filling any such spaces and providing an inert gas curtain which prevents any ambient air from being sucked into the molten metal stream within bore 14.

On the left part of the FIGURE an alternative design in shown. While there is a gas distribution plenum chamber 34 provided directly beneath the gas permeable member 20 there is a gas channel 36 extending from said gas distribution plenum chamber 34 (which is a ring like member) to the first flat contact surface 18 at a position intermediate between the inner circumference of the said gas permeable member 20 and the through bore 14 of the pouring tube.

Nozzle 10 is provided with a corresponding gas channel 38 being equipped at its lower end with an enlarged section 38*e* being in fluid connection to gas channel 36. At its opposite end the gas channel 38 merges into an adapter 40 providing within nozzle 10 and adapted to receive a gas feeding pipe.

According to this embodiment any inert gas is introduced via gas channel 38 (38*e*) and gas channel 36 into gas distribution plenum chamber 34 and next into the gas permeable member 20.

The invention claimed is:

1. An assembly comprising:

a refractory pouring tube, comprising a first end (16) with a first flat contact face (18), perpendicular to a longitudinal axis (A) of the refractory pouring tube, and a pouring channel (14), extending from said first flat contact face (18) towards a second end of the refractory pouring tube, which pouring channel (14) terminates in at least one outlet opening at the second end of the refractory pouring tube, wherein the first end (16) of the refractory pouring tube is equipped with at least one gas permeable member (20), which gas permeable member (20) being arranged such that one of its surfaces (20*s*) forms part of the first flat contact face (18) and wherein the first end (16) is further equipped with at least one gas channel (36), extending from at least one surface of the gas permeable member (20) other than the surface (20*s*) forming part of the first flat contact face (18) to the first flat contact surface (18): and a second refractory component (10), provided with a second flat contact face (28) and a second pouring channel (14), designed for bearing with said second flat contact face (28) against the first flat contact face (18) of the refractory pouring tube and providing a continuous pouring channel (14) at a transition region between the first and second pouring channel (14), wherein the second refractory component (10) is equipped with at least one gas feeding channel (38), an outlet end of which terminates in its mounted position, into the at least one gas channel (36) of the refractory pouring tube, while an inlet end (40) of said gas feeding channel (38) is adapted to receive a gas feeding means.

2. The assembly according to claim 1, wherein said gas permeable member (20) is ring shaped.

3. The assembly according to claim 1 , wherein said gas permeable member (20) is a separate entity, positioned within the first end (16) of the refractory pouring tube.

4. The assembly according to claim 1, wherein said gas permeable member (20) is co-formed during manufacture of the tube.

5. The assembly according to claim 1, wherein a gas distribution chamber (34) is arranged between the gas permeable member (20) and the gas channel (36).

6. The assembly according to claim 1, wherein the gas permeable member (20) is arranged along an outer periphery (12*p*) of the first flat contact face (18).

7. The assembly according to claim 1, wherein the gas feeding channel (38) has an enlarged cross sectional area at its outlet end.

* * * * *